US006389621B1

(12) United States Patent
Elliott et al.

(10) Patent No.: US 6,389,621 B1
(45) Date of Patent: May 21, 2002

(54) FITTED SHEET WITH CORNER POCKETS AND LONGITUDINALLY DIVIDING SLIT

(76) Inventors: Robert D. Elliott; Pamela A. Elliott, both of 14962 SE. 107th Ave., Summerfield, FL (US) 34491

( * ) Notice: Subject to any disclaimer, the term of this patent is extended or adjusted under 35 U.S.C. 154(b) by 0 days.

(21) Appl. No.: 09/912,333

(22) Filed: Jul. 26, 2001

(51) Int. Cl.[7] ..... A47G 9/04
(52) U.S. Cl. ..... 5/497; 5/486
(58) Field of Search ..... 5/497, 486, 495, 5/496, 498, 499, 482

(56) References Cited

U.S. PATENT DOCUMENTS

| | | | | |
|---|---|---|---|---|
| 738,674 A | | 9/1903 | Grattan | 5/497 |
| 2,630,588 A | | 3/1953 | Levin | 5/497 |
| 2,730,728 A | * | 1/1956 | Roberts | 5/486 |
| 3,083,379 A | | 4/1963 | Marinsky | 5/497 |
| 3,694,832 A | | 10/1972 | Jamison | 5/497 |
| 4,245,365 A | * | 1/1981 | Large | 5/496 |
| 4,698,865 A | * | 10/1987 | Walker | 5/495 |
| 5,173,976 A | * | 12/1992 | Jubinville | 5/499 |
| 5,465,440 A | * | 11/1995 | Heptner | 5/497 |
| 6,122,782 A | * | 9/2000 | Chedid | 5/497 |

FOREIGN PATENT DOCUMENTS

| | | | | |
|---|---|---|---|---|
| GB | 2225717 | * | 6/1990 | 5/486 |

* cited by examiner

*Primary Examiner*—Alexander Grosz
(74) *Attorney, Agent, or Firm*—Patent Trademark Services; Thomas Zack; Joseph H. McGlynn

(57) ABSTRACT

A fitted sheet has cutout portions at both of its bottom corners that permit, with the aid of separable fasteners located at the cutout portions, to convert the sheet from a planar configuration to a configuration comprising two pockets adapted to retain the sheet on the mattress.

6 Claims, 2 Drawing Sheets

FITTED SHEET WITH CORNER POCKETS AND LONGITUDINALLY DIVIDING SLIT

BACKGROUND OF THE INVENTION

This invention relates in general to bed clothes, and in particular to a fitted top sheet.

When making up a bed with sheets, it is desirable that the corners of the sheet be kept in place to insure a smooth fit, and to prevent the dislodgement of the sheet when in use.

DESCRIPTION OF THE PRIOR ART

Fitted sheets are known in the prior art. For example, U.S. Pat. No. 738,674 to Grattan discloses a sheet having excess material at the sides and ties to secure the sheet at the corners.

U.S. Pat. No. 2,630,588 to Levin discloses a fitted sheet having straight cutouts at all four corners.

U.S. Pat. No. 3,089,379 to Marinsky discloses a fitted sheet having two straight portions at all four corners with a cutout between the corners.

U.S. Pat. No. 3,694,832 to Jamison discloses a fitted sheet having 45 degree angles at the top and 45 degree angles at the bottom.

The present invention is directed to a fitted sheet that is cut at a 45 degree angle at the bottom to eliminate excess material and to prevent the sheet from becoming shifted or dislodged, all as will be detailed in the specification that follows hereafter.

SUMMARY OF THE INVENTION

This invention relates to a fitted top sheet that has cut out bottom portions each of which portions are oriented at angles to be folder about the bottom corners of a mattress.

It is the primary object of the present invention to provide for an improved fitted sheet.

Another object is to provide for such a sheet which has bottom corner cutout portions with fasteners to permit a sheet to be firmly attached to a mattress, whereby the sheet can be converted from a first planar configuration to a second, pocketed configuration.

It is an other object of the present invention to provide for an improved fitted sheet which can be easily and quickly attached to a mattress.

It is an other object of the present invention to provide for an improved fitted sheet which will be securely attached to a mattress so it will not become dislodged during use.

These and other objects and advantages of the present invention will become apparent to readers from a consideration of the ensuing description and the accompanying drawings.

DESCRIPTION OF THE PREFERRED EMBODIMENT

Figure 1:
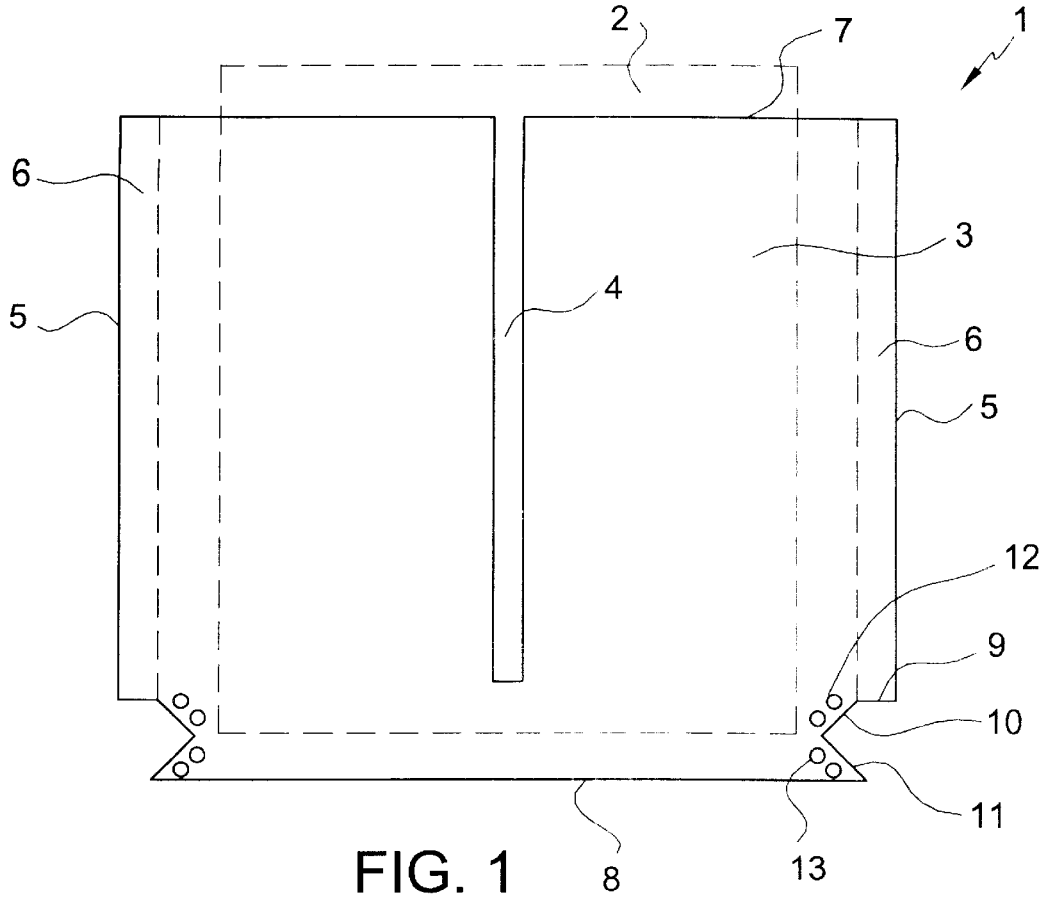
FIG. 1 is a top view of the sheet of the present invention before it is folded about a mattress.

FIG. 1 is a top view of the present invention 1. The unfolded sheet 1 has a generally rectangular shaped portion 3 with a center slit 4 which extends from approximately the top of the sheet to a position adjacent the bottom of the sheet. The slit 4 will allow a person sleeping on the left side of the bed to adjust his/her half of the sheet without disturbing a person sleeping on the right side of the bed.

The sheet 1 of the present invention has a top edge 7 and a bottom edge 8 with side edges 5 extending between the top and the bottom of the sheet. Each side edge has an enlarged portion 6 which will allow the sheet to be tucked under a mattress 2. At each of the bottom corners of the sheet 3 a cutout portion is provided. The cut out portion comprises a first horizontal straight line portion 9 which makes an approximate 90° angle with the side edge 5. A second straight line portion 10 makes an approximately 135° angle with the portion 9. A third straight line portion of the cut out 11 makes an approximately 90° angle with the portion 10. Portion 11 is joined to portion 10 on one end, and is joined to bottom edge 8 at the other end.

Portions 10, 11 have complimentary fasteners 12, 13 disposed therealong. When the portions 10, 11 are folder about the corner of the mattress 2, the fasteners 12, 13 will be secured together in order the bottom of the sheet firmly and securely to the bottom of the mattress 2. It should be noted that while the fasteners 12, 13 are shown as snap fasteners, any conventional fastener such as, but not limited to, hook and loop fasteners could be used, as long as the fastener will securely hold the bottom portion of the sheet onto the bottom of the mattress. In addition, the number of fasteners is not material. For example, two fasteners are shown in FIG. 1 and five fasteners are shown in FIG. 2.

Figure 2:
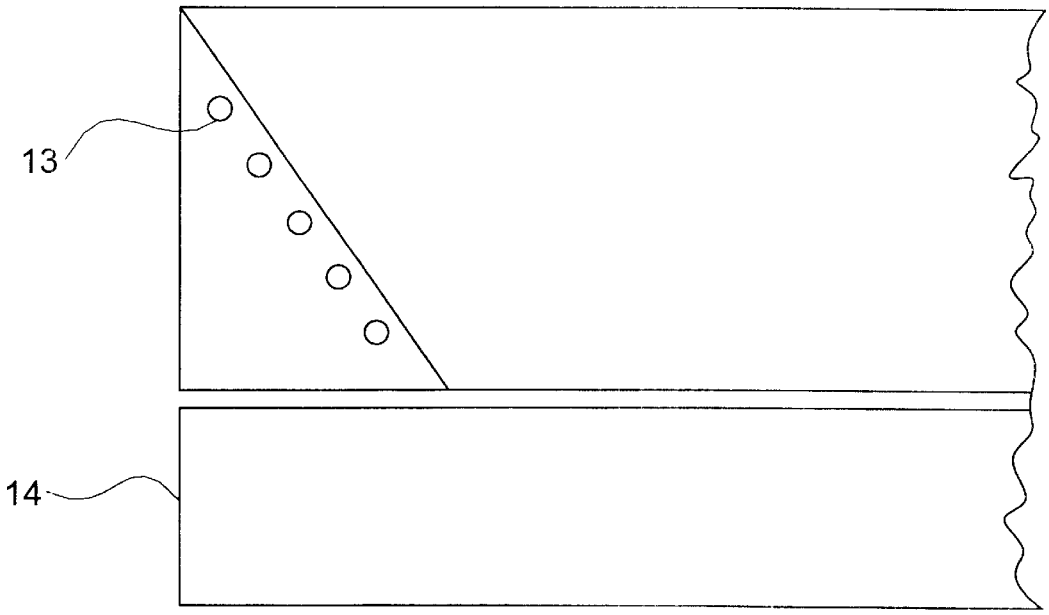
FIG. 2 is a side view of one of the bottom corners of the sheet after it is folded about a mattress.

FIG. 2 shows the sheet in its final folded position about the corner of the mattress. In this figure the portion 6 has been folded under the mattress 2 and extends between the mattress 2 and the box spring 14. In addition, portion 10 has been folded down along the side of the mattress and is not seen since it is under portion 11 in FIG. 2. Portion 11 has been folded onto portion 10 and the fasteners 13 have been engaged with the fasteners 12 thereby forming two pockets that retain the sheet on the mattress.

Figure 3:
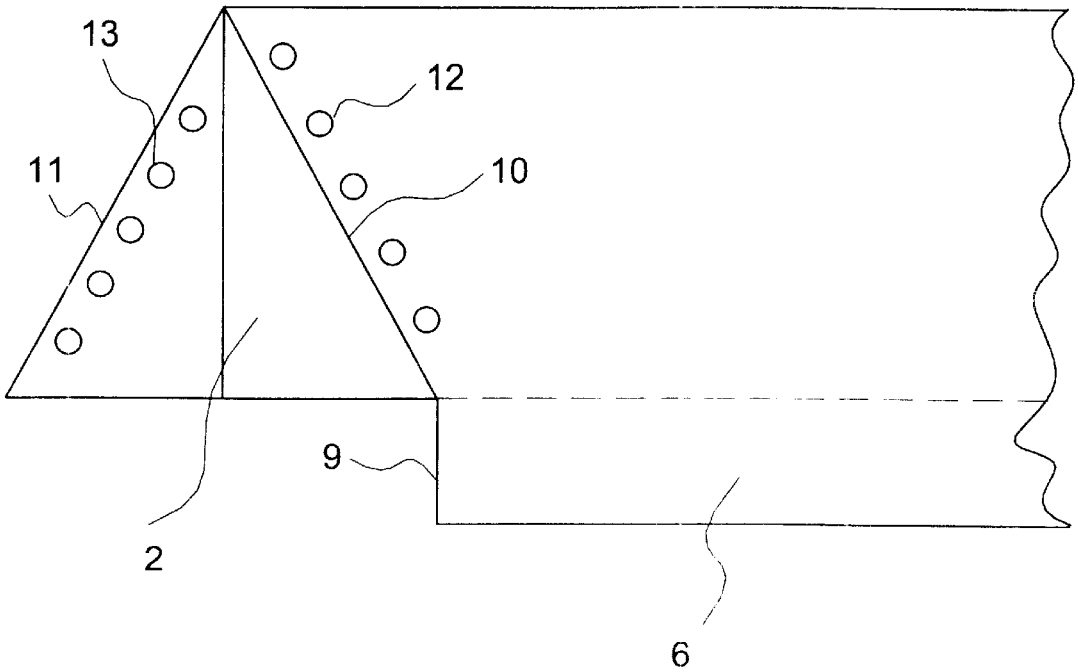
FIG. 3 is a side view of one of the bottom corners of the sheet before it is completely folded about a mattress.
Figure 4:
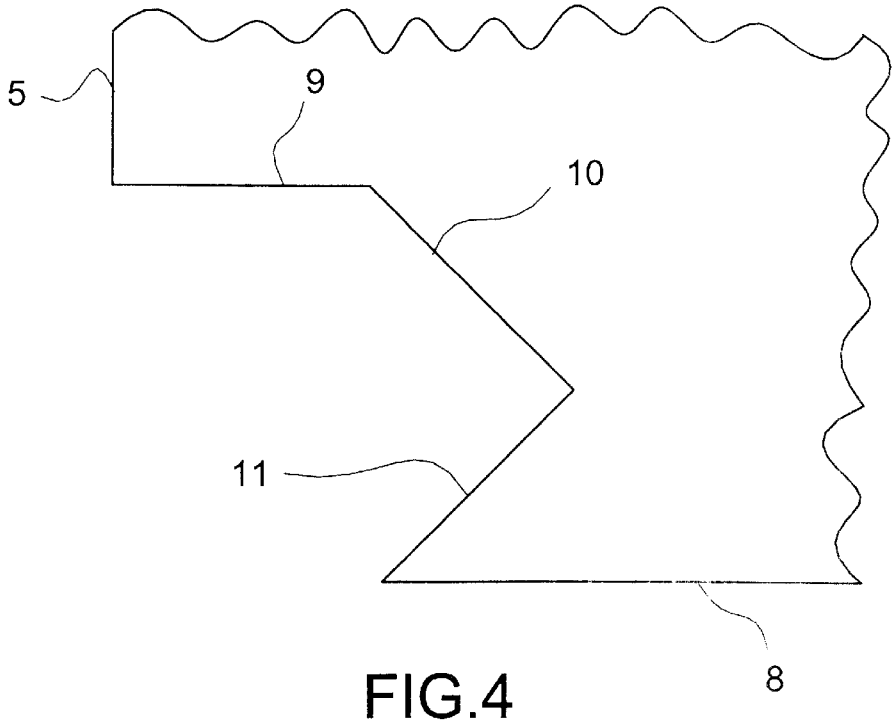
FIG. 4 is a partial view of one of the bottom corners of the sheet showing the various angles which make up each bottom corner of the sheet.

FIG. 3 shows the bottom of the sheet with the portion 10 folded down along the side of the mattress 2, but before the portion 11 has been folded over portion 10. The extended portion 6 has not, as yet, been folded under the mattress 2.

In use, a person would first fold portion 10 down along the side of the mattress 2, as shown in FIG. 3. Then the portion 6 would be folded under the mattress 2. Next, portion 11 would be folded over portion 10, as shown in FIG. 2, and the fasteners 12, 13 would be engaged. This same procedure would be performed on the opposite bottom corner and this would quickly and easily secure the bottom of the sheet to the bottom of the mattress.

Although the preferred embodiment of the present invention and the method of using the same has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A fitted sheet adapted to be converted with the use of separable fastener means between a first generally planar configuration, and a second configuration comprising two corner pockets adapted to retain a sheet on a mattress, comprising:

a sheet having a top edge, a bottom edge and side edges joining said top edge and said bottom edge, said sheet having extended means along each side edge for being folded under a mattress, said sheet having two bottom corners, each bottom corner comprising a cutout portion defined by three generally straight line portions comprising a first portion connected to said side edge, a second portion connected to said first portion at approximately a 135° angle, a third portion connected to said second portion, and said third portion also being connected to said bottom edge of said sheet.

2. The fitted sheet as claimed in claim 1, wherein said sheet has a slot extending from a position adjacent said top edge of said sheet to a position adjacent said bottom edge of said sheet.

3. The fitted sheet as claimed in claim 1, wherein said first portion is connected to said side portion at approximately a 90° angle.

4. The fitted sheet and mattress as claimed in claim 1, wherein said third portion is connected to said second portion at approximately a 90° angle.

5. The fitted sheet and mattress as claimed in claim 1, wherein complimentary fastener means are secured along said second and third portions for securing said bottom corners of said sheet to a mattress.

6. The combination as claimed in claim 5, wherein said fastener means are snap fasteners.

* * * * *